US007194226B2

(12) United States Patent
Adachi et al.

(10) Patent No.: US 7,194,226 B2
(45) Date of Patent: Mar. 20, 2007

(54) IMAGE FORMING APPARATUS FEATURING AN IMAGE BEARING MEMBER CHARGED BY A CHARGING MEANS AND A DEVELOPER CHARGE PROVIDING MEANS

(75) Inventors: Motoki Adachi, Shizuoka (JP); Yasunari Watanabe, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 833 days.

(21) Appl. No.: 10/268,723

(22) Filed: Oct. 11, 2002

(65) Prior Publication Data

US 2003/0077088 A1 Apr. 24, 2003

(30) Foreign Application Priority Data

Oct. 15, 2001 (JP) ..... 2001-316628

(51) Int. Cl.
*G03G 15/00* (2006.01)

(52) U.S. Cl. ..... 399/149

(58) Field of Classification Search ..... None
See application file for complete search history.

(56) References Cited

U.S. PATENT DOCUMENTS

| | | | | |
|---|---|---|---|---|
| 5,765,076 | A * | 6/1998 | Ogata et al. | 399/168 |
| 5,832,336 | A * | 11/1998 | Kawasaki et al. | 399/71 |
| 6,215,967 | B1 * | 4/2001 | Takeda et al. | 399/43 |
| 6,415,127 | B1 | 7/2002 | Yamamoto et al. | 399/284 |
| 6,421,512 | B2 | 7/2002 | Watanabe et al. | 399/149 |
| 2005/0249515 | A1 * | 11/2005 | Furukawa et al. | 399/53 |

* cited by examiner

*Primary Examiner*—Quana Grainger
(74) *Attorney, Agent, or Firm*—Fitzpatrick, Cella, Harper & Scinto

(57) ABSTRACT

The invention provides an image forming apparatus provided with an image bearing body, and developer charge providing device for providing a charge thereby charging residual developer, remaining on the image bearing body after image transfer, to a normal polarity. The developer charge providing device charges an area of the image bearing body, and such area is further charged by the charging device. When the voltage applied to the developer charge providing device for charging such area is, varied, the voltage applied to the charging means for charging such area is also varied. Thus the image forming apparatus can execute uniform charging in stable manner over a prolonged period.

20 Claims, 6 Drawing Sheets

IMAGE FORMING APPARATUS FEATURING AN IMAGE BEARING MEMBER CHARGED BY A CHARGING MEANS AND A DEVELOPER CHARGE PROVIDING MEANS

BACKGROUND OF THE INVENTION

1. Field of the Invention

The present invention relates to an image forming apparatus comprising charging means for charging an image bearing body, and developer charge providing means provided in an upstream position of the charging means in the rotating direction of the image bearing body and adapted to charge, in a normal polarity, residual developer remaining on the image bearing body after transfer of a developer image.

2. Related Background Art

In an image forming apparatus such as an electrophotographic apparatus or an electrostatic recording apparatus, for the purpose of charging the surface of an image bearing body which is constituted by a body to be charged such as a photosensitive body or a dielectric body, there is conventionally employed a corona charging method which is a non-contact charging method of applying a corona discharge, generated by the application of a high voltage to a thin corona discharge wire, to the surface of the image bearing body-thereby achieving the charging thereof.

on the other hand, in recent years, there is being principally adopted a contact-charging method of contacting a charging member of roller type or blade type with the surface of the image bearing body, constituting the body to be charged, and applying a voltage to the charging member thereby charging the surface of the image bearing body, because of a lower voltage in the process, a lower amount of ozone generation and a lower cost. In particular, the charging member of roller type is capable of stable charging over a prolonged period.

The voltage applied to the charging member can be a DC voltage only, but there may also be applied an oscillating voltage to alternately induce discharge in the positive side and in the negative side, thereby achieving uniform charging.

It is already known, for example, that the application of an oscillating voltage, formed by superposing an AC voltage having a peak-to-peak voltage at least equal to twice of a threshold voltage for starting the discharge on the charged body under the application of a DC voltage (charging start voltage) and a DC voltage (DC offset bias), to the charging member shows an effect of averaging the charge on the charged body, thereby achieving uniform charging. The waveform of the oscillating voltage is not limited to a sinusoidal wave but can also be a rectangular wave, a triangular wave or a pulse wave. The oscillating voltage includes also a voltage of rectangular shape obtained by periodically turning on and off a DC voltage, and a DC voltage of which value is periodically varied to obtain an output same as a superposed voltage of an AC voltage and a DC voltage.

In the following, a contact charging method of effecting charging by applying an oscillating voltage to the charging member will be called "AC charging method". Also a contact charging method of effecting charging by applying a DC voltage only will be called "DC charging method (system)".

Recently there is known an image forming apparatus employing a cleanerless system, which is a system for recovering the transfer residual toner, remaining on the photosensitive drum after the image transfer, into a developing apparatus. In the cleanerless system, it is preferable to regulate the electrical polarity of the transfer residual toner to a normal polarity until such transfer residual toner is recovered in the developing apparatus. It is however not easy to regulate the polarity of the transfer residual toner to the normal polarity by the voltage applied by the charging means (regardless whether it is of contact type or non-contact type).

Consequently it is preferred to an auxiliary charging member, constituting developer charge providing means which provides the transfer residual toner with a charge thereby regulating the charge polarity of the transfer residual toner to the normal polarity. The auxiliary charging means is given a predetermined voltage from a power supply apparatus and provides the transfer residual toner, remaining on the photosensitive drum, with a charge. However, since the remaining amount is variable depending for example on the image density, a sufficient charge cannot be provided to the transfer residual toner if the voltage applied to the auxiliary charging member is not appropriate. Also, since the photosensitive drum is charged by the voltage applied from the auxiliary charging member, there may result a situation, depending on the potential after the charging by the auxiliary charging member, where the charging for latent image formation on the photosensitive drum becomes not uniform, thereby deteriorating the image quality.

The contact charging method can resolve the drawbacks such as scraping of the photosensitive drum since the voltage applied to the contact charging means can be made lower in comparison with the case of the non-contact charging method. However, since the contact charging means is in contact with the image bearing body, the toner, the external additive thereof or the like may be deposited on the contact charging member, thereby causing a smear thereon. Such a smear results in an image defect such as a defective charging.

In order to avoid such drawback, an auxiliary charging member such as a brush is provided as the developer charge providing means in the upstream side of the charging member in the rotating direction of the photosensitive drum. Such a method allows to select a low voltage for setting to the charging means. It is also rendered possible to provide the toner or the external additive on the image bearing body with such a charge as not to stick to the charging member, thereby preventing smear of the charging member. Also the contact charging member is rendered capable of stable charging in uniform manner over a prolonged period.

SUMMARY OF THE INVENTION

An object of the present invention is to provide an image forming apparatus capable of uniform charging for a long period stably, without being adversely affected by the charging potential of the image bearing body by the developer charge providing means.

Another object of the present invention is to provide an image forming apparatus capable of preventing that the charging means is smeared by the residual developer remaining after the transfer.

Still another object of the present invention is to provide an image forming apparatus capable of optimizing the image bearing body provided by developer charge providing means.

The above-mentioned objects can be attained, according to the present invention, by an image forming apparatus comprising an image bearing body, charging means receiving a variable voltage for charging the image bearing body, development means for developing an electrostatic latent image formed on the image bearing body with a developer, transfer means for transferring an image formed on the image bearing body onto a transfer material, and developer charge providing means which provides residual developer, remaining on the image bearing body after the transfer, with a charge thereby charging the residual developer to a normal polarity, or which is positioned in the upstream side of the charging means in the rotating direction of the image bearing body:

wherein a part on the image bearing body, charged by the developer charge providing means, is charged by the charging means; and in the case the voltage applied to the developer charge providing means for the aforementioned part is varied, the voltage applied to the charging means for the aforementioned part is also varied.

DETAILED DESCRIPTION OF THE PREFERRED EMBODIMENTS

Figure 1:
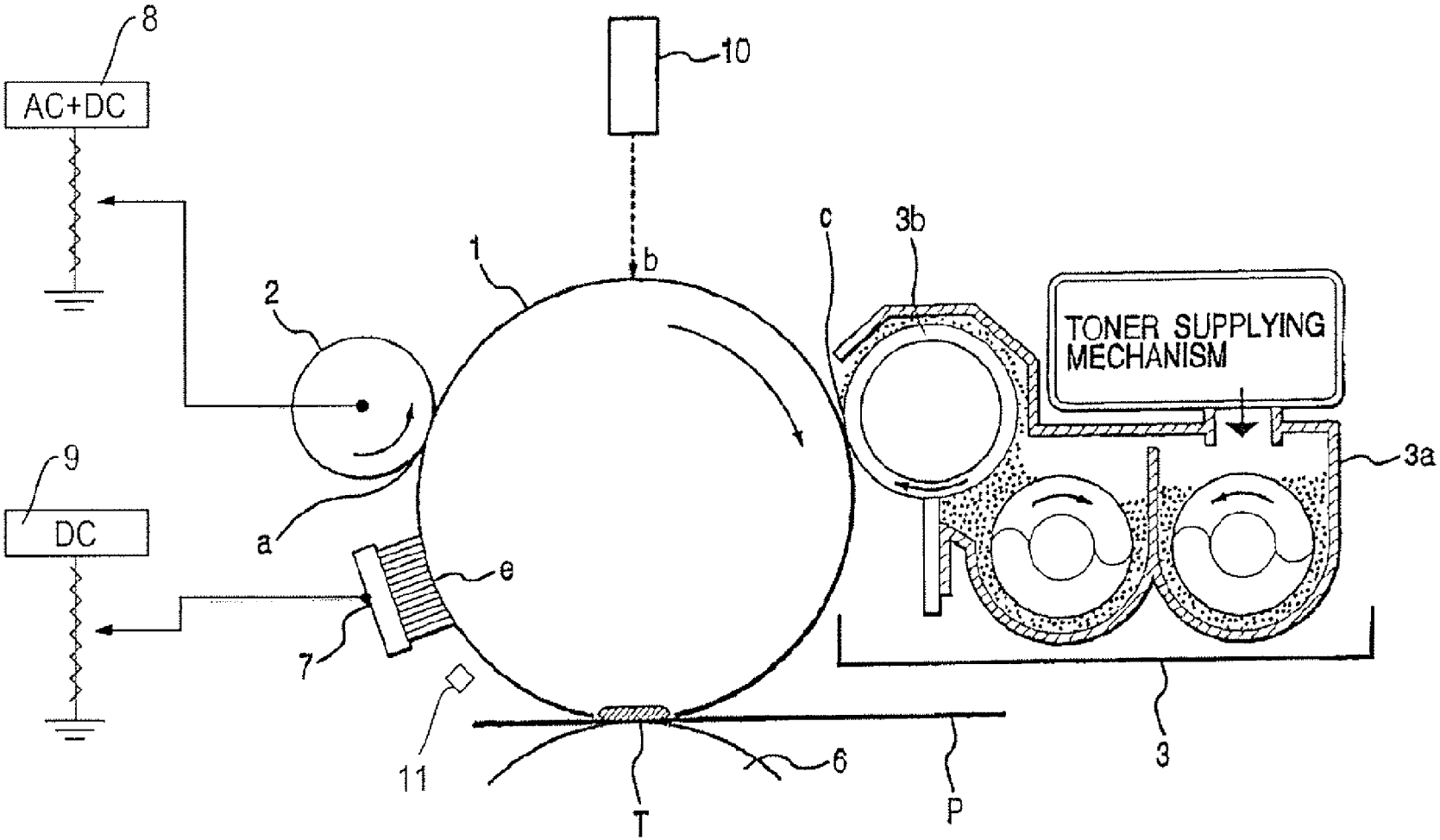
FIG. 1 is a view showing an image forming apparatus embodying the present invention.

In the following there will be explained an image forming apparatus (image recording apparatus) constituting an embodiment of the present invention. FIG. 1 is a schematic conceptual view showing the configuration of an image forming apparatus of the present invention.

The image forming apparatus of the present embodiment is a laser beam printer with a maximum passable sheet size of A3 size, includes a photosensitive drum 1 constituting an image bearing body, a charging roller 2 for charging the photosensitive drum 1, an exposure apparatus 10 for exposing the photosensitive drum 1 thereby forming an electrostatic latent image, a development apparatus 3 for executing reversal development on the photosensitive body, and a transfer apparatus 6 for transferring an image, developed by the development apparatus, onto a recording sheet.

The image forming apparatus of the present embodiment employs a cleanerless system which recovers the residual toner after the image transfer into the development apparatus 3, and, for realizing such cleanerless system, the image forming apparatus of the present embodiment is equipped with toner charging means (developer charge providing means) 7 which is provided in a position downstream of the transfer apparatus 6 in the rotating direction of the photosensitive drum and upstream of the charging roller 2 in the rotating direction of the photosensitive drum and which regulates the charge polarity of the residual toner to the negative polarity which is a normal polarity of the toner.

Now there will be explained an image forming process executed in image forming means of the present embodiment. At first, the photosensitive drum 1 starts to rotate in response to an image processing signal emitted from a controller unit.

Then the charging roller 2, which is maintained in contact with the photosensitive drum 1 and is rotated by the rotation thereof, executes charging of the photosensitive drum 1. The charging roller 2 receives a voltage, formed by superposing a DC voltage to an AC voltage, from a power supply apparatus, and the output of the power supply apparatus is so controlled that the charge distribution on the photosensitive drum 1 becomes uniform.

A uniformly charged part of the photosensitive drum 1 is subjected to the formation of an electrostatic latent image by the exposure apparatus, and is conveyed to the development apparatus 3. The development apparatus 3 is composed of a developing container 3*a* for containing toner supplied from a toner replenishing mechanism and conveying the toner to a developing portion, and a developing sleeve 3*b* for executing image development on the photosensitive drum 1 in the developing portion c with the toner conveyed by a screw provided in the developing container 3*a*. A developer, constituted by toner and carrier and present on the developing sleeve 3*b*, is supplied to the electrostatic latent image formed on the photosensitive drum 1 to execute development, thereby forming a toner image on the photosensitive drum. In the present embodiment, as shown in FIG. 1, the developing sleeve 3*b* rotates in a direction, which is the same as the rotating direction of the photosensitive drum. The rotating direction is not restricted to such same direction, but the developing sleeve 3*b* may be rotated in a direction opposite to that of the photosensitive drum 1.

The toner image, formed with the toner in the development apparatus 3, is carried by the rotation of the photosensitive drum to the transfer apparatus 6. In the transfer apparatus 6, a transfer unit T transfers the toner image on the photosensitive drum onto a recording material P fed by feeding means. The recording material P bearing the transferred toner image is separated from the photosensitive drum and conveyed to unrepresented fixation apparatus.

After a transferring step, residual toner remaining on the photosensitive drum 1 is carried by the rotation thereof to the toner charging means 7 constituting the developer charge providing means. The residual toner is subjected to a regulation of the charge polarity to a negative polarity by the charging means 7, and then passes the charging roller 2 by the rotation of the photosensitive drum 1.

The residual toner on the photosensitive drum, after passing the charging roller 2, is carried again to the development apparatus 6. In this state, the residual toner regulated to the negative polarity is removed from the photosensitive drum 1 by an attractive force toward the developing sleeve 3*b*.

In the following there will be explained the control method of each apparatus constituting the cleanerless system and the image forming apparatus.

(1) Cleanerless System

The printer of the present embodiment employs a cleanerless system and is therefore not equipped with a cleaning apparatus exclusively for eliminating the transfer residual toner, which remains in a certain amount on the surface of the photosensitive drum 1 after the transfer of the toner image onto the recording material P. There is adopted a cleanerless system in which the transfer residual toner, remaining on the photosensitive drum 1 after the transfer, is carried by the continued rotation of the photosensitive drum 1 through a charging portion a and an exposure portion b to the developing portion c, and subjected to a cleaning (recovery) simultaneous with the development by the development apparatus 3. In this operation, there are formed an electric field for recovering the residual toner from a dark part of the photosensitive drum 1 to the developing sleeve 3*b* and an electric field for executing development with toner from the developing sleeve 3*b* to a light part of the photosensitive drum 1.

Since the transfer residual toner on the surface of the photosensitive drum 1 passes through the exposure portion b, the exposure step is executed across such residual toner, but the exposure is not affected much as the amount of the transfer residual toner is small.

However, the transfer residual toner immediately after the transfer step mixedly contains toner of a normal charge polarity, that of a reversed polarity (reversed toner) and that of a low charge amount, and such reversed polarity toner or toner of a low charge amount, if passed through the charging portion a, is deposited on the charging roller 2 to cause an excessive toner smear thereon, thereby leading to a defective charging.

Also, in order to effectively execute the cleaning simultaneous with development by the development apparatus 3 to the transfer residual toner on the photosensitive drum 1, it is essential that the transfer residual toner remaining on the photosensitive drum 1 and carried to the developing portion c has a normal charge polarity and such a charge amount capable of developing the electrostatic latent image on the photosensitive drum by the development apparatus. The reversed polarity toner or the toner with an inappropriate charge amount cannot be removed from the photosensitive drum and recovered in the development apparatus, and leads to a defective image.

Also, with the recent diversification of the requirements of the user, there is often encountered a continuous printing operation of images of a high print rate such as photographic images, leading to the generation of a large amount of the transfer residual toner at a time and thereby enhancing the above-described drawbacks.

In the present embodiment, the toner charging means 7 is a brush-shaped member of an adequate electrical conductivity, is so provided that the brush portion is in contact with the surface of the photosensitive drum 1, and is given an unrepresented negative voltage from a power source 9. A symbol e indicates a contact portion between the brush portion and the surface of the photosensitive drum 1. Thus, the transfer residual toner, present on the photosensitive drum 1 and passing through the toner charging means 7, is regulated to a negative charge polarity, which is the normal polarity.

Such regulation of the transfer residual toner to the normal negative polarity allows an increase in the mirror reflection force to the photosensitive drum 1, at the charging process of the surface of the photosensitive drum 1 across the transfer toner in the charging portion a of the charting roller in the further downstream position, thereby preventing deposition of the transfer residual toner onto the charging roller 2. Also the regulation of the transfer residual toner to the negative polarity improves the recovery thereof from the photosensitive drum 1 to the developing sleeve 3*b*.

(2) Charging Means

The charging means employs the contact charging method (charging roller), and is given an oscillating voltage by a power supply apparatus 8 which is formed by superposing an AC voltage with a DC voltage. More specifically, there is employed an AC charging method utilizing a sinusoidal AC voltage of a frequency f of 1000 Hz and a peak-to-peak voltage Vpp of 1600 V, superposed with a DC voltage Vdc. Thus the periphery of the photosensitive drum is uniformly charged at a potential equal to Vdc. In order to render the charged potential Vd variable, the Vdc is rendered variable within a range from −500 V to −750 V.

(3) Charged Potential Vd and Post-transfer Potential

The apparatus of the present embodiment executes image density control in order to realize a high image quality. The image density control is a method, for suppressing the variation in the density resulting from a fluctuation in developing properties in time and depending on the environmental conditions, of forming plural patch images at a predetermined timing for example on the photosensitive drum with different charging conditions and developing conditions, detecting the densities of such plural patch images with a density sensor 11 and, based on the result of such density detection, selecting such a charging condition and a developing condition, namely voltages applied to the charging roller 2 and the development apparatus 3, as to obtain an appropriate density. In such control, the voltage applied to the charging roller 2 is rendered selectable within a range from −500 V to −750 V, while the charged potential Vd is rendered variable within a range from −500 V to −750 V.

A variation in the value Vd also causes a change in the optimum value of the voltage applied to the transfer apparatus. Therefore, in the present embodiment, the applied transfer voltage is linked with the voltage applied to the charging roller in such a manner that the voltage actually applied to the charging roller 2 and the transfer voltage always has a potential difference of 1000 V. Such method enables to always achieve the transfer in stable manner.

Because the value Vd is variable, the potential on the photosensitive drum 1 after the transfer assumes various states. In case Vd=−500 V, both an exposed part and a non-exposed part assume a value of about 0 V, but, in case Vd=−750 V, an exposed part and a non-exposed part respectively assume values of about −100 V and about −400 V, thus resulting in a potential difference of about 300 V.

(4) Prevention of Toner Smear on Charging Roller

The potential on the photosensitive drum 1 after the image transfer is various, for example in an exposed part and a non-exposed part, as explained in the foregoing section (3).

Figure 2:
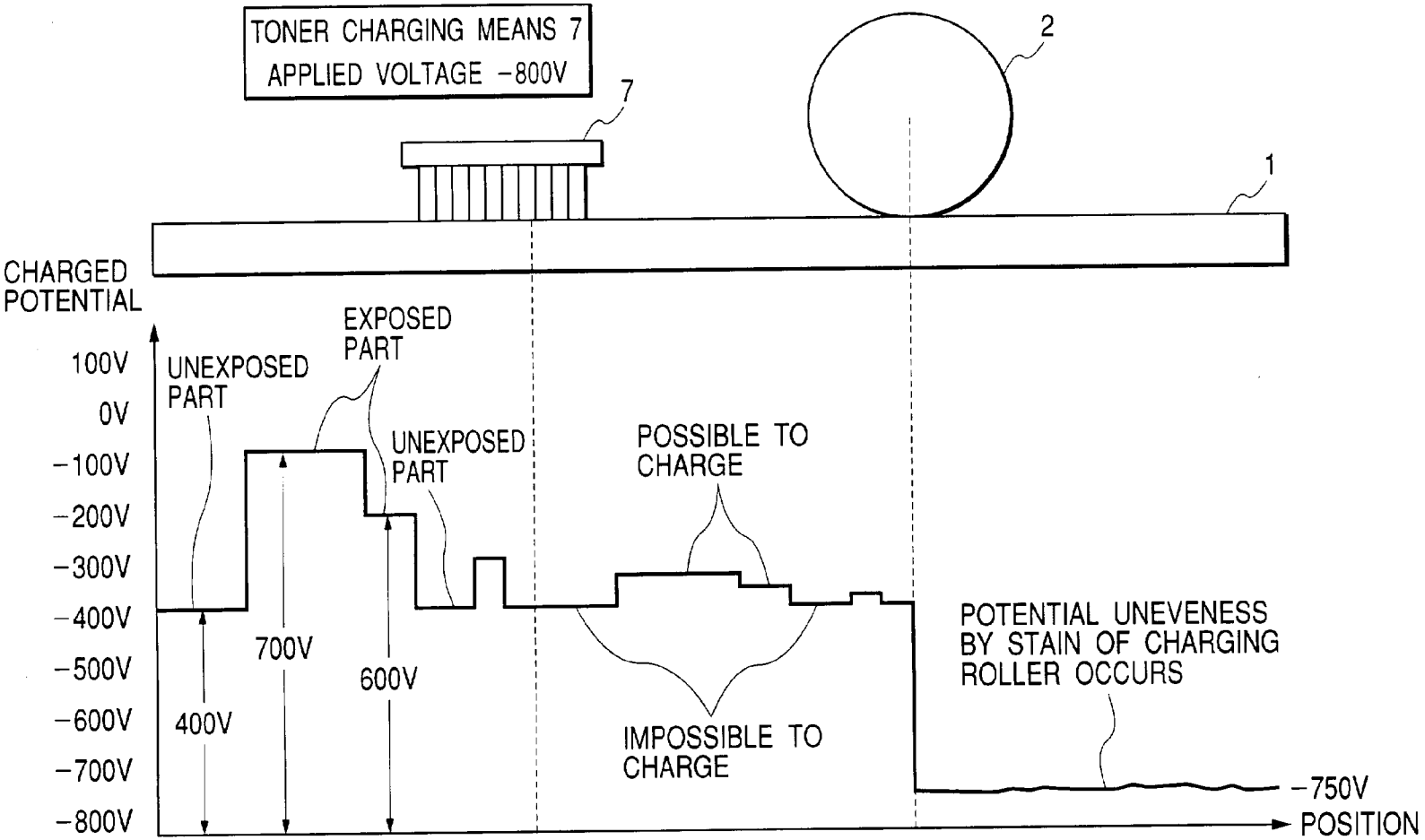
FIG. 2 is a chart showing the relationship of a potential on a photosensitive drum in the present invention (when charge cannot be provided)

FIG. 2 shows the relationship of the potential on the photosensitive drum, in the case a sufficient charge cannot be provided to a non-exposed part (dark area), wherein the abscissa indicates the position in the circumferential direction of the photosensitive drum while the ordinate indicates the charged potential of the photosensitive drum.

At the image formation, an electrostatic latent image is formed on the photosensitive drum in the exposure portion, in such a manner that the photosensitive drum 1 after passing the transfer means has a charged potential within a range of −100 V to −200 V in an exposed part (light area) and a charged potential of −400 V in a non-exposed part (dark area). Control of the image density for example in a halftone image is realized by varying the potential from −100 V to −200 V in the exposed part (light area).

Referring to FIG. 2, in the case of a brush voltage of −800 V applied to the toner charging means and a charged potential Vd=−750 V of the photosensitive drum, a sufficient charge can be provided to the transfer residual toner present in the exposed part (light area) because of a sufficient potential difference (600 V to 700 V) between the brush voltage and the potential of the exposed part (light area), but a sufficient charge cannot be provided to fogging toner and external additives present in the non-exposed part (dark area) because the potential difference between the brush voltage and the potential of the non-exposed part (dark area) is 400 V and insufficient. Therefore, a toner smear may be generated on the charging roller, leading to a defect in the image.

With reference to Table 1, there will be explained the relationship between the potential difference and the smear on the charging roller in the apparatus of the present embodiment. In Table 1, X indicates a state where the charging roller shows a smear, Δ indicates a state where the charging roller is somewhat smeared though such smear does not appear on the image, and ○ indicates a state where the charging roller does not show a smear. Also in Table 1, the potential difference indicates the difference between the voltage Vb applied to the toner charging means and the potential V on the photosensitive body in a stage entering the toner changing means (Vb being larger in negative value. The results in Table 1 indicate that a minimum difference of 600 V is required between the voltage Vb applied to the toner charging means and the potential Vt on the photosensitive body after the transfer in order to provide the transfer residual toner with an appropriate charge, and otherwise an effect of preventing the toner smear on the charging roller cannot be expected. With a potential difference of 550 V, there is generated a smear, though slight, on the charging roller at a high printing ratio.

TABLE 1

| Potential difference (V) | Smear on charging roller |
|---|---|
| 400 | X |
| 500 | X |
| 550 | Δ |
| 600 | ○ |
| 700 | ○ |
| 800 | ○ |

(5) Potential Formed by Toner Charging Means on Toner Charging Means

Figure 3:
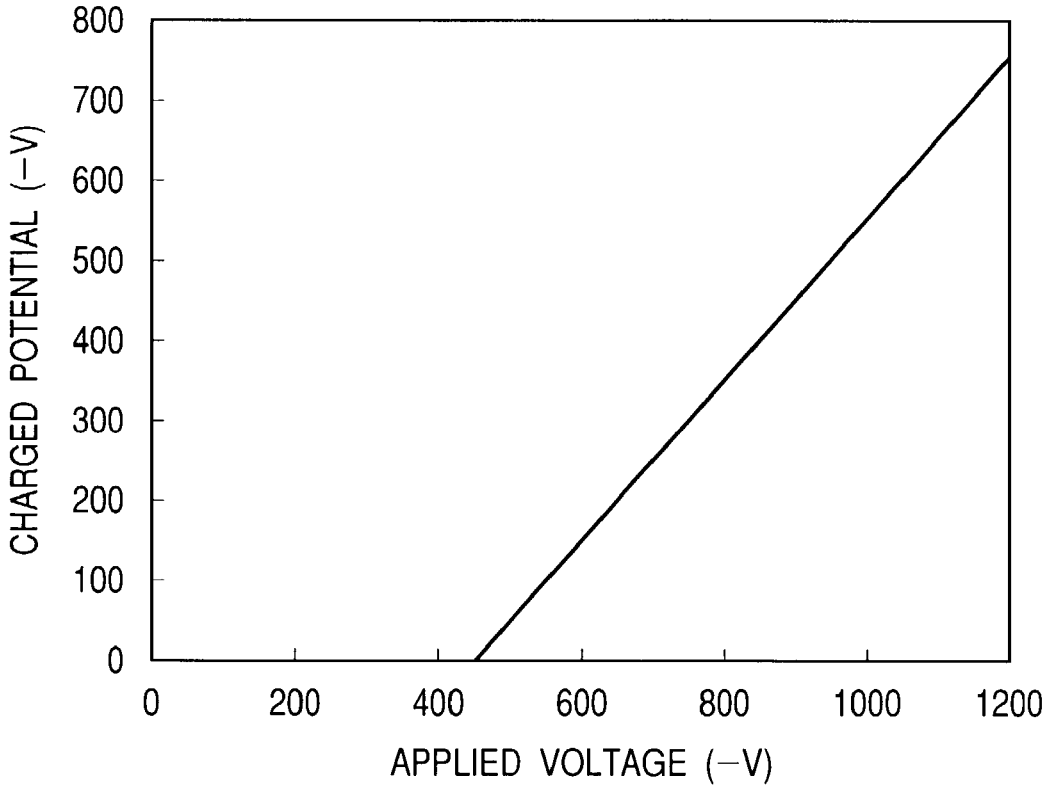
FIG. 3 is a chart showing the relationship between a voltage applied by toner charging means of the present invention and a charged potential.

FIG. 3 shows the relationship between the voltage applied to the toner charging means and the charged potential of the photosensitive drum. A voltage applied to the toner charging means 7 by a power source 9 causes charging not only of the transfer residual toner but also of the photosensitive drum 1.

When the voltage applied to the toner charging means does not exceed a certain value (hereinafter called charging start voltage), no discharge is created from the toner charging means to the photosensitive drum, so that the photosensitive drum is not charged. In case the voltage applied to the toner charging means exceeds the charging start voltage, a discharge is created from the toner charging means to the photosensitive drum, whereby the photosensitive drum 1 is charged to a potential proportional to the voltage. In an actual measurement, the charging start voltage is about −450 V. In the present embodiment, judging from the relationship shown in FIG. 3, the potential on the photosensitive drum is assumed as a value obtained by subtracting −450 V from the voltage applied to the toner charging means.

An increase in the voltage applied to the toner charging means (stated differently, an increase in the potential difference between the voltage Vb applied to the toner charging means and the potential on the photosensitive drum entering the toner charging means) naturally increases the charge providing power to the transfer residual toner, but an excessively high voltage applied to the toner charging means causes an over-charging of the photosensitive drum, resulting in white streak image defects in the form of brush traces in a halftone image.

Figure 4:
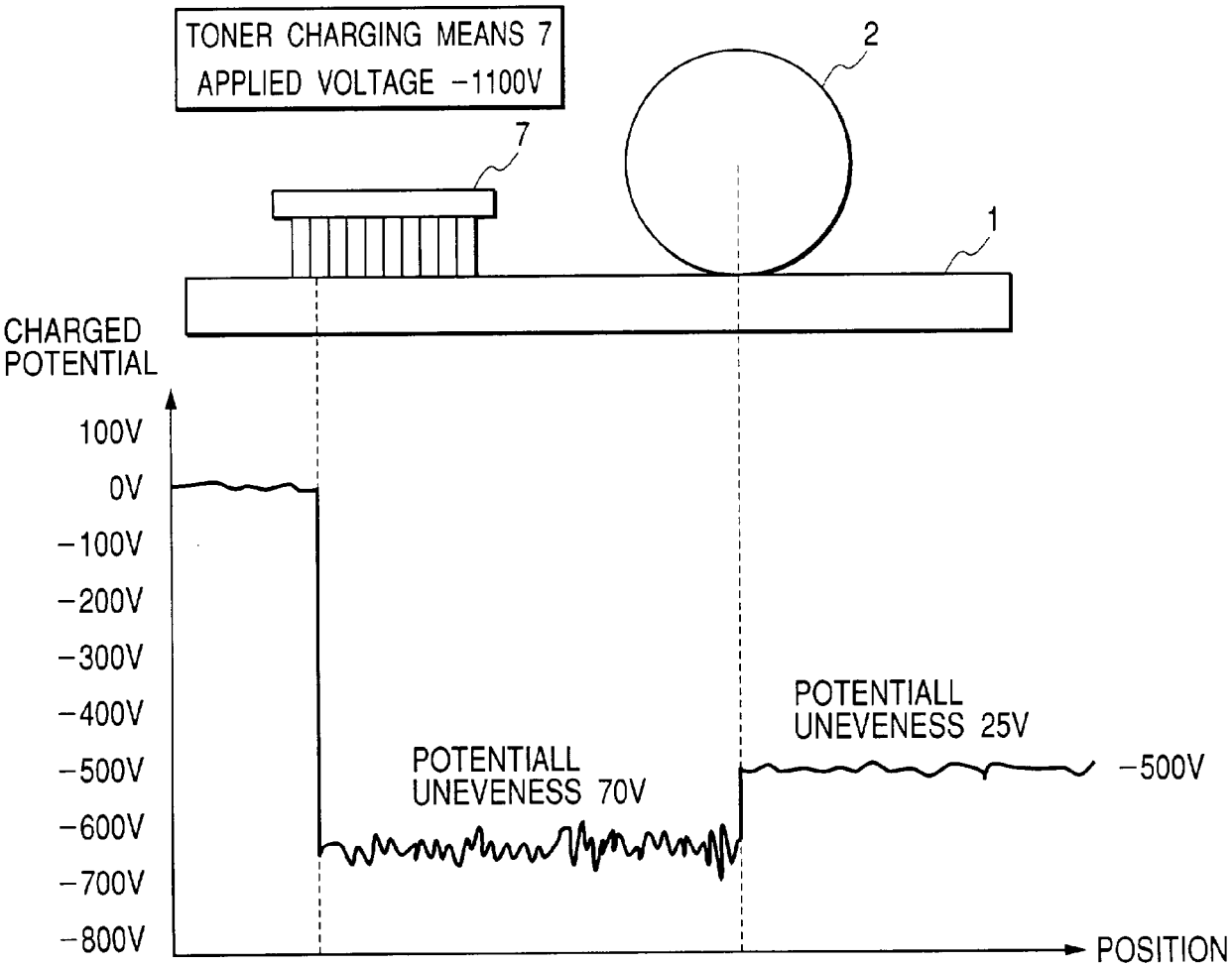
FIG. 4 is a chart showing the relationship of the charged potential on the photosensitive drum when the potential of the toner charging means of the present invention is high.

FIG. 4 shows the relationship of the potential on the photosensitive drum in case, for a charged potential Vd=−500 V of the photosensitive drum 1, a charged potential formed by the voltage applied from the toner charging means is lower than Vd. Now there will be explained the mechanism of white streak generation with reference to FIG. 4.

When a voltage of −1100 V is applied to the toner charging means 7, the surface of the photosensitive drum 1 is charged to about −650 V. The photosensitive body, after passing the toner charging means and being charged therein, is charged also in passing the charging roller, but the potential on the photosensitive body, once becoming higher than the charged potential, is not reduced completely to −500 V even with the AC charging method, thus leading to white streaks in the form of brush traces in a halftone image. In such state, the potential shows an unevenness of about 25 V, indicating an unevenness in the charging.

Table 2 indicate the relationship of the charged potential Vd, the auxiliary charged potential Va and the white streaks. In Table 2, ○ indicates a state without white streaks, Δ indicates a state with a few white streaks, and X indicates a state with many white streaks.

TABLE 2

| Vd (V) | Va (V) | White streaks |
|---|---|---|
| −500 | −350 | ○ |
| | −450 | ○ |
| | −500 | Δ |
| | −550 | X |
| | −650 | X |
| −700 | −500 | ○ |
| | −600 | ○ |
| | −650 | ○ |
| | −700 | Δ |
| | −750 | X |
| | −800 | X |

(6) Vd and Potential Setting of Toner Charging Means

Figure 5:
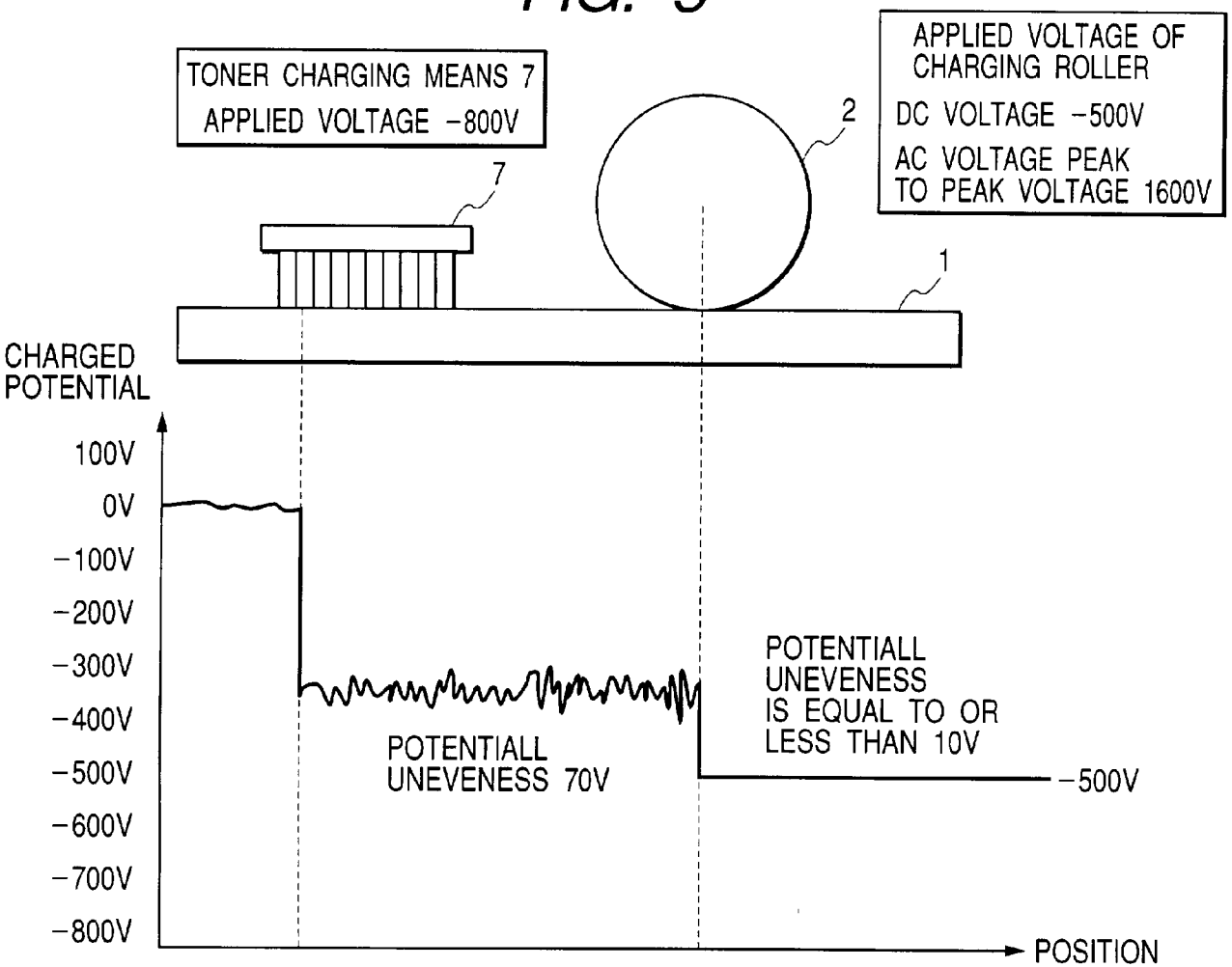
FIG. 5 is a chart showing the relationship of the charged potential on the photosensitive drum in the present invention.
Figure 6:
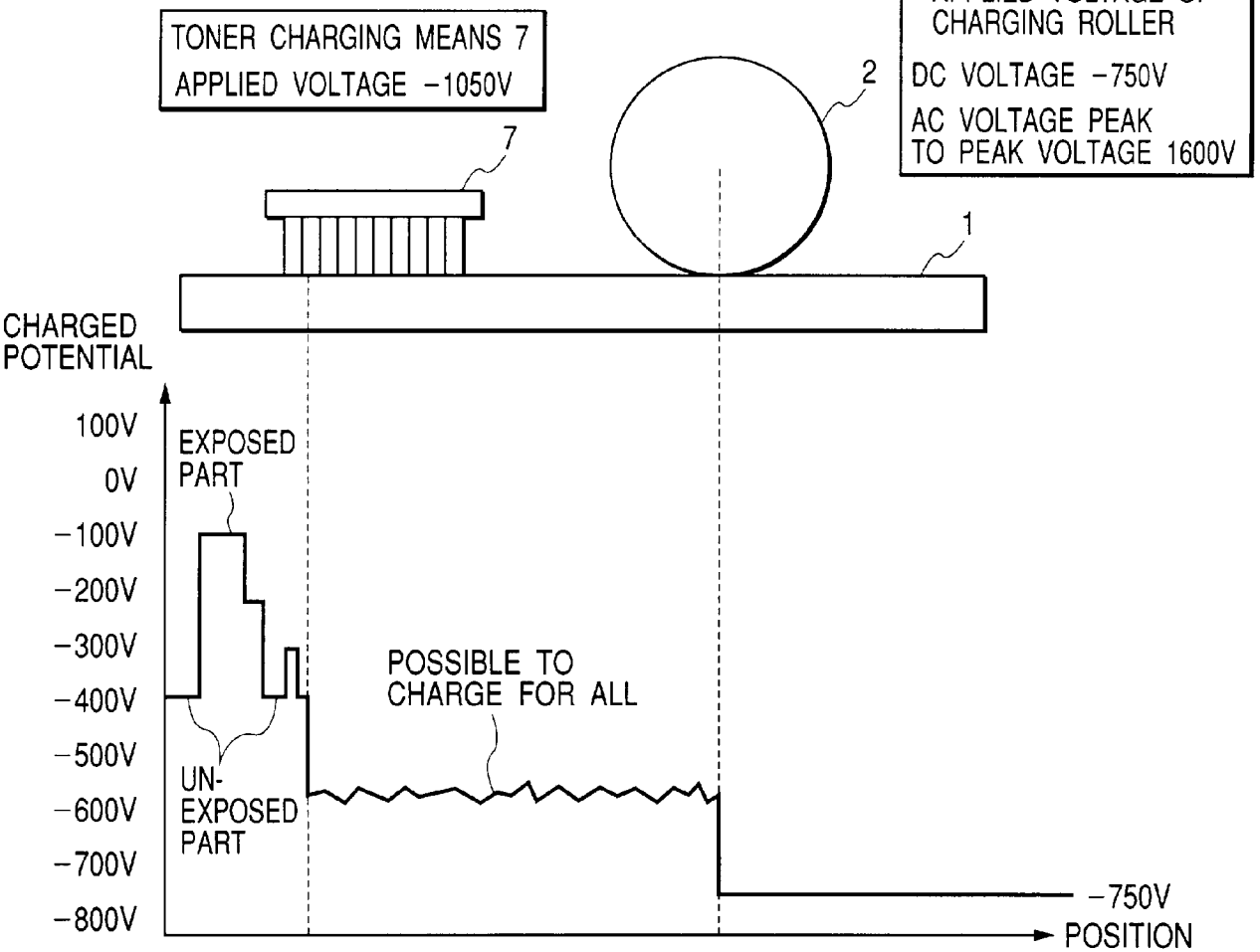
FIG. 6 is a chart showing the relationship of the charged potential on the photosensitive drum in case a high charging potential is used in the present invention.

In the Present Embodiment, in Order to Achieve prevention of the toner smear on the charging roller and preventing the generation of the white streak image defect at the same time, the voltage Va applied to the toner charging means is rendered variable within a range from −800 V to −1050 V so as to be higher by 300 V than Vd (for example Va=−1050 V for Vd=−750 as shown in FIG. 6, or Va=−800 V for Vd=−500 as shown in FIG. 5). Consequently, the potential Vt on the photosensitive drum after the transfer and the voltage Vb applied to the toner charging means have a potential difference of about 650 V, thereby preventing the toner smear on the charging roller. The relationship between Va and Vd can be indicated in the following formula (A), and also satisfies that "the absolute value of the potential Va formed on the photosensitive drum by the toner charging means is smaller than the absolute value of the charged potential Vd" for preventing the generation of the white streaks.

$$|Vd|-|Va|\approx 150V \quad (A)$$

FIG. 5 shows the relationship of the potential on the photosensitive drum 1 in the case a voltage of −800 V is applied from the toner charging means 7 in such a manner that the charged potential on the photosensitive drum converges to −500 V.

As shown in FIG. 5, the surface potential of the photosensitive drum 1, after passing the transfer position of the transfer apparatus 6, is about 0 V. However, such surface potential is variable depending on whether the surface belongs to an exposed part or a non-exposed part in the preceding step and also on the influence of a high transfer voltage in the transfer apparatus 6.

In passing the toner charging means 7, the photosensitive drum 1 is charged by a voltage of −800 V applied to the toner charging means 7. A part of the photosensitive drum 1, having passed the toner charging means 7, assumes a surface potential of −350 V.

The voltage applied to the toner charging means 7 is set at such a voltage (−800 V in the present case) that the surface potential (−350 V in the present case) of the photosensitive drum after passing the toner charging means is smaller in the absolute value than the target potential (minimum −500 V in the present case) and that a sufficient charge can be provided to the toner. In this state, the potential unevenness of the photosensitive drum is reduced but is still as large as 70 V or larger.

Then, the part of the photosensitive drum 1, having a surface potential of −350 V, passes the charging roller 2. In this state, the charging roller 2 is given an AC voltage obtained by superposing a DC voltage of −500 V and an AC voltage of a peak-to-peak value of 1600 V, and such AC charging method causes the surface potential of the aforementioned part of the photosensitive drum 1 to converge to −500 V. In this state, the range of fluctuation of the surface potential of the photosensitive drum 1 is suppressed to 10 V or less.

On the other hand, FIG. 6 shows the relationship of the potential on the photosensitive drum 1 in case a voltage of −1050 V is applied from the toner charging means 7 in such a manner that the charged potential on the photosensitive drum converges to −750 V.

In passing the toner charging means 7, the photosensitive drum 1 is charged by a voltage of −1050 V applied to the toner charging means 7. Since both an exposed part (light area) and a non-exposed part (dark area) have a sufficient potential difference (600 V or larger), a potential can be provided to the surface of the photosensitive drum after passing the toner charging means. A part of the photosensitive drum 1, having passed the toner charging means 7, assumes a surface potential of −600 V.

The voltage applied to the toner charging means is set at such a voltage (−1050 V in the present case) that the surface potential (−600 V in the present case) of the photosensitive drum after passing the toner charging means is smaller in the absolute value than the target potential (minimum −750 V in the present case) and that a sufficient charge can be provided to the toner.

Also the potential unevenness on the photosensitive drum is reduced because the difference between the absolute value of the voltage applied to the toner charging means and the absolute potential in the non-exposed part (dark area) is 600 V or larger. Consequently, by setting the charged potential of the photosensitive drum 1 at a large absolute value, a sufficient charge can be provided to the toner both in the exposed part and in the non-exposed part, whereby it is rendered possible to reduce the potential unevenness in the exposed part and the non-exposed part by the toner charging means, while preventing the toner smear on the charging roller. Also, as the toner charging means does not execute charging beyond the charged potential, there can be achieved uniform charging without a charging unevenness such as white streaks.

Subsequently, the part of the photosensitive drum 1, having a surface potential of −600 V, passes the charging roller 2. In this state, the charging roller 2 is given an AC voltage obtained by superposing a DC voltage of −750 V and an AC voltage of a peak-to-peak value of 1600 V, and such AC charging method causes the surface potential of the aforementioned part of the photosensitive drum 1 to converge to −750 V. In this state, the range of fluctuation of the surface potential of the photosensitive drum 1 is suppressed to 10 V or less.

In the present embodiment, as explained in the foregoing, the toner charging means 7 provides the toner with a charge and also executes auxiliary charging on the photosensitive drum 1. Thereafter the charging roller 2 corrects the charged potential of the photosensitive drum, thereby achieving an appropriate charging. Also the voltage of the toner charging means 7 is so selected as to maintain a certain potential difference with respect to the desired charged potential of the photosensitive drum 1 (namely the difference between the voltage applied to the toner charging means 7 and the charged potential of the photosensitive drum; 300 V in the present case), whereby uniform charging can be made possible in stable manner and over a prolonged period without causing the toner smear on the charging roller or the uneven charging resulting from an over-charging by the toner charging means.

The present invention is not limited to the embodiment explained in the foregoing. In the foregoing embodiment, the voltage applied to the toner charging means and that applied to the transfer member are varied in continuous manner with a constant potential difference with respect to the charged potential, but such method is not restrictive and the applied voltages may be varied stepwise.

Also the foregoing embodiment employs the AC charging method in which an AC voltage (a voltage formed by superposing a peak-to-peak voltage with a DC voltage) is applied to the charging roller, but there may also be employed a DC charging method utilizing the application of a DC voltage. Such method allows to dispense with the power source for generating the peak-to-peak voltage, thereby enabling to provide the product inexpensively. Also various voltages are not limited to those shown in the foregoing embodiment but can be arbitrarily selected according to the various conditions of the apparatus.

Also in the foregoing embodiment, the toner charging means 7 is composed of a fixed brush, but such configuration is not restrictive and there may also be employed a rotary brush or a non-brush member such as a conductive blade, a roller or a sheet. Also in the foregoing embodiment, the number of the charging members is selected as two, namely the toner charging means and the charging roller, but there may be provided three or more charging members. Also, a DC voltage is applied to the toner charging means 7, but such configuration is not restrictive and it is also possible, for example, to apply an oscillating voltage, formed by superposing an AC voltage with a DC voltage, to the toner charging means 7. However, the photosensitive body should not be given a potential exceeding the charged potential thereof.

The present invention is subject to various modifications and alterations within a range not departing from the scope of the present invention.

What is claimed is:

1. An image forming apparatus comprising:

an image bearing member;

charging means to which a variable voltage is applied, for charging said image bearing member;

development means for developing an electrostatic latent image formed on said image bearing member with a developer;

transfer means for transferring an image formed on said image bearing member onto a transfer material;

developer charge providing means for charging residual developer remaining on said image bearing member with a normal charge polarity remaining on said image bearing member, the developer charge providing means being positioned upstream of said charging means and downstream of said transfer means in a rotating direction of the image bearing member;

wherein said developer charge providing means charges an area of said image bearing member with a voltage applied to said developer charge providing means and said charging means charges the area of said image bearing member by a voltage applied to said charging means, wherein an absolute value of a charge potential of the area of said image bearing member charged by said developer charge providing means is lower than an absolute value of a charge potential of the area of the image bearing member charged by said charging means, wherein, as the voltage applied to said developer charge providing means decreases when said developer charge providing means charges the area of said image bearing member, the voltage applied to said charging means decreases when said charging means charges the area of said image bearing member; and wherein an image density of the developer in an image formation is detected by a density detector, and the voltage applied to said developer charge providing means is determined based on the detected image density of the developer.

2. An image forming apparatus according to claim 1, wherein a difference between an absolute value of a voltage applied to said developer charge providing means and an absolute value of a charged potential of said image bearing member in an area, which is upstream of said developer charge providing means after said image bearing member passes through the transfer means is equal to or more than 600 V.

3. An image forming apparatus according to claim 1, wherein said residual developer charged with the normal charge polarity by said developer charge providing means is recovered by said development means.

4. An image forming apparatus according to claim 1, wherein said development means executes reversal development.

5. An image forming apparatus according to claim 1, wherein said charging means is a charging member which executes charging in contact with said image bearing member.

6. An image forming apparatus according to claim 5, wherein said charging member is provided with an oscillating voltage formed by superposing an AC voltage with a DC voltage.

7. An image forming apparatus according to claim 5, wherein said charging member comprises a roller.

8. An image forming apparatus according to claim 1, wherein said developer charge providing means comprises a brush including electroconductive fibers.

9. An image forming apparatus according to claim 1, wherein said developer charge providing means is provided with an oscillating voltage formed by superposing an AC voltage with a DC voltage.

10. An image forming apparatus comprising:

an image bearing member;

charging means to which a variable voltage is applied, for charging said image bearing member, wherein said charging means is supplied with an oscillating voltage formed by superposing an AC voltage with a DC voltage;

development means for developing an electrostatic latent image formed on said image bearing member with a developer;

transfer means for transferring an image formed on said image bearing member onto a transfer material; and developer charge providing means for charging residual developer remaining on said image bearing member with a normal charge polarity remaining on said image bearing member, said developer charge providing means being positioned upstream of said charging means and downstream of said transfer means in a rotating direction of said image bearing member, wherein said developer charge providing means charges an area of said image bearing member and the area of said image bearing member is further charged by said charging means, wherein as the voltage applied to the said developer charge providing means is varied when said developer charge providing means charges the area of said image bearing member, the voltage applied to the said charging means is varied when said charging means charges the area of said image bearing member, and wherein as the voltage applied to said developer charge providing means decreases when said developer charge providing means charges the area of said image bearing member, the voltage applied to the said charging means decreases when said charging means charges the area of said image bearing member.

11. An image forming apparatus according to claim 10, wherein an absolute value of a charged potential of the area of said image bearing member charged by said developer charge providing means is lower than an absolute value of a charged potential of the area of said image bearing member charged by said charging means.

12. An image forming apparatus according to claim 10, wherein a difference between an absolute value of a voltage applied to said developer charge providing means and an absolute value of a charged potential of said image bearing member in a part which is an upstream of said developer charge providing means after said image bearing member passes through said transfer means is equal to or more than 600 V.

13. An image forming apparatus according to claim 10, wherein when a voltage applied to said developer charge providing means to charge the area of said image bearing member is varied, the variable voltage applied to said charging means to charge the area of said image bearing member is also varied.

14. An image forming apparatus according to claim 10, wherein said residual developer charged in the normal charge polarity by said developer charge providing means is recovered by said development means.

15. An image forming apparatus according to claim 10, wherein said development means executes reversal development.

16. An image forming apparatus according to claim 10, wherein said charging means is a charging member, which executes charging in contact with said image bearing member.

17. An image forming apparatus according to claim 16, wherein said charging member includes a roller.

18. An image forming apparatus according to claim 10, wherein said developer charge providing means comprises a brush including electroconductive fibers.

19. An image forming apparatus according to claim 10, wherein said developer charge providing means is provided with an oscillating voltage formed by superposing an AC voltage with a DC voltage.

20. An image forming apparatus according to claim 10, further comprising density detecting means for detecting an image density of the developer in an image formation, and the voltage applied to said developer charge providing means is determined based on a detected image density of the developer.

* * * * *

UNITED STATES PATENT AND TRADEMARK OFFICE

CERTIFICATE OF CORRECTION

PATENT NO. : 7,194,226 B2
APPLICATION NO. : 10/268723
DATED : March 20, 2007
INVENTOR(S) : Motoki Adachi et al.

It is certified that error appears in the above-identified patent and that said Letters Patent is hereby corrected as shown below:

ON THE TITLE PAGE

At Item (57), Abstract, line 9, “is,” should read --is--.

IN THE DRAWINGS

Sheet 4, Fig. 4, “POTENTIALL” (both occurrences) should read --POTENTIAL--;
Sheet 5, Fig. 5, “POTENTIALL” (both occurrences) should read --POTENTIAL--.

COLUMN 1

Line 29, “body-thereby” should read --body thereby--;
Line 30, “on” should read --On--.

COLUMN 2

Line 13, “to” should READ --to use--.

COLUMN 5

Line 38, “has” should read --have--;
Line 66, “charting” should read --charging--.

COLUMN 6

Line 31, “as” should read --so as--;
Line 55, “various,” should read --variable,--.

COLUMN 7

Line 30, “value.” should read --value.)--.

COLUMN 8

Line 4, “as” should read --to be--;
Line 34, “indicate” should read --indicates--;
Line 55, “Order to Achieve” should read --order to achieve--.

UNITED STATES PATENT AND TRADEMARK OFFICE

CERTIFICATE OF CORRECTION

PATENT NO. : 7,194,226 B2
APPLICATION NO. : 10/268723
DATED : March 20, 2007
INVENTOR(S) : Motoki Adachi et al.

It is certified that error appears in the above-identified patent and that said Letters Patent is hereby corrected as shown below:

COLUMN 11

Line 18 Claim 1, “materals;” should read --material; and--;
Line 25 Claim 1, “member;” should read --member,--;
Line 42 Claim 1, “member;” should read --member,--;

COLUMN 12

Line 41 Claim 10, “the” (second occurrence) should be deleted;
Line 47 Claim 10, “the” (second occurrence) should be deleted.

Signed and Sealed this

Eighteenth Day of March, 2008

JON W. DUDAS
*Director of the United States Patent and Trademark Office*